US008267405B1

(12) United States Patent
Tsai et al.

(10) Patent No.: US 8,267,405 B1
(45) Date of Patent: Sep. 18, 2012

(54) GAME MACHINE

(75) Inventors: Chi-Ming Tsai, Hemei Town (TW); I-Chiang Yang, Hemei Town (TW)

(73) Assignee: Feiloli Electronic Co., Ltd, Changhua County (TW)

( * ) Notice: Subject to any disclaimer, the term of this patent is extended or adjusted under 35 U.S.C. 154(b) by 0 days.

(21) Appl. No.: 13/113,060

(22) Filed: May 22, 2011

(51) Int. Cl.
*A63F 9/00* (2006.01)

(52) U.S. Cl. ..... 273/460; 273/459; 273/454

(58) Field of Classification Search ..... 273/440, 273/447, 448, 454, 459, 460
See application file for complete search history.

(56) References Cited

U.S. PATENT DOCUMENTS 7,192,342 B2 * 3/2007 Shoemaker, Jr. ..... 463/7
2011/0086687 A1 * 4/2011 Guarnieri ..... 463/7

FOREIGN PATENT DOCUMENTS

JP 2006116035 A * 5/2006
JP 2010259596 A * 11/2010

* cited by examiner

*Primary Examiner* — Raleigh W. Chiu

(57) ABSTRACT

A game machine includes a main frame, a partition front slantingly mounted on a middle portion of the main frame. A collecting device is mounted onto an underside of the partition and multiple falling ball sensing units are mounted onto an upside of the partition. Multiple prize dispensing devices are mounted onto an internal panel of the main frame and electrically connected to a corresponding one of the falling ball sensing units. A control unit is secured on the main frame and an operational unit is disposed to an upper portion of the main frame, wherein the operational unit is electrically connected to the control unit. When starting a game, the operational unit firstly catches a ball and targets a selected falling ball sense unit, and then releasing the ball to the targeted falling ball sensing units for driving the prize the dispensing device.

6 Claims, 7 Drawing Sheets

GAME MACHINE

BACKGROUND OF THE INVENTION

1. Field of the Invention

The present invention relates to a game machine, and more particularly to a game machine that provides a prize by sensing a falling ball.

2. Description of Related Art

A conventional cabinet-type game machine, such as a doll catch machine, is popular in an amusement park. The doll catch machine, for example, has a catcher that is firstly moved along an X-axis and a Y-axis above the dolls. Secondly, the catcher is moved along a Z-axis to catch the aligned doll. Lastly, the caught doll falls into a passage and the player can get the doll as a reward from the passage.

However, the suspensory game machine has been popular for a long time and becomes bored to the consumers. The types of dolls are often changed, but few consumers want to try again. Consequently, the play ways of the suspensory game machine need to be advantageously altered.

The present invention has arisen to mitigate and/or obviate the disadvantages of the conventional suspensory game machine.

SUMMARY OF THE INVENTION

The main objective of the present invention is to provide an improved game machine that provides a prize by sensing a falling ball.

To achieve the objective, the game machine in accordance with the present invention comprises a main frame having a prize dispensing hole defined in a lower portion of a front panel thereof. A partition is front slantingly mounted on a middle portion of the main frame. The partition includes at least one opening defined in one side thereof and communicating with the prize dispensing hole, and at least one side plate upwardly extending therefrom for separating the at least one opening Multiple prize dispensing devices are respectively mounted onto an internal panel of the main frame. An operational unit is disposed to an upper portion of the main frame. The operational unit includes an X-axis moving device, a Y-axis moving device and a Z-axis moving device, wherein the Z-axis moving device is mounted onto an underside of the X-axis moving device. A catcher is mounted on the Z-axis moving device for catching/releasing a ball. Multiple falling ball sense units are respectively mounted onto an upside of the partition, wherein the prize dispensing device is driven to dispense a prize when a corresponding one of the falling ball sense units senses the falling ball. A control unit is secured on the front panel of the main frame for controlling and operating the X-axis moving device and the Y-axis moving device to make the catcher targeting a selected one of the falling ball sense units. A collecting device is mounted onto an underside of the partition. The collecting device includes a bowl defined in a front portion of the partition and an indentation defined in a bottom of the bowl, wherein the ball is positioned and partially received in the indentation when the game is finished. A sensor is disposed in the collecting device near the indentation, wherein the sensor transfers a signal to the operational unit to make the X-axis moving device with the Z-axis moving device moving to its original position when the sensor senses the ball in the indentation.

The win probability of the game machine in accordance with the present invention is completely directed to the operations of the user and is not directed to the hardware of the game machine. Consequently, the fairness of the game machine of the present invention is promoted and the game machine is attractive because it has a new and novel play method.

Further benefits and advantages of the present invention will become apparent after a careful reading of the detailed description with appropriate reference to the accompanying drawings.

DETAILED DESCRIPTION OF THE INVENTION

Figure 1:
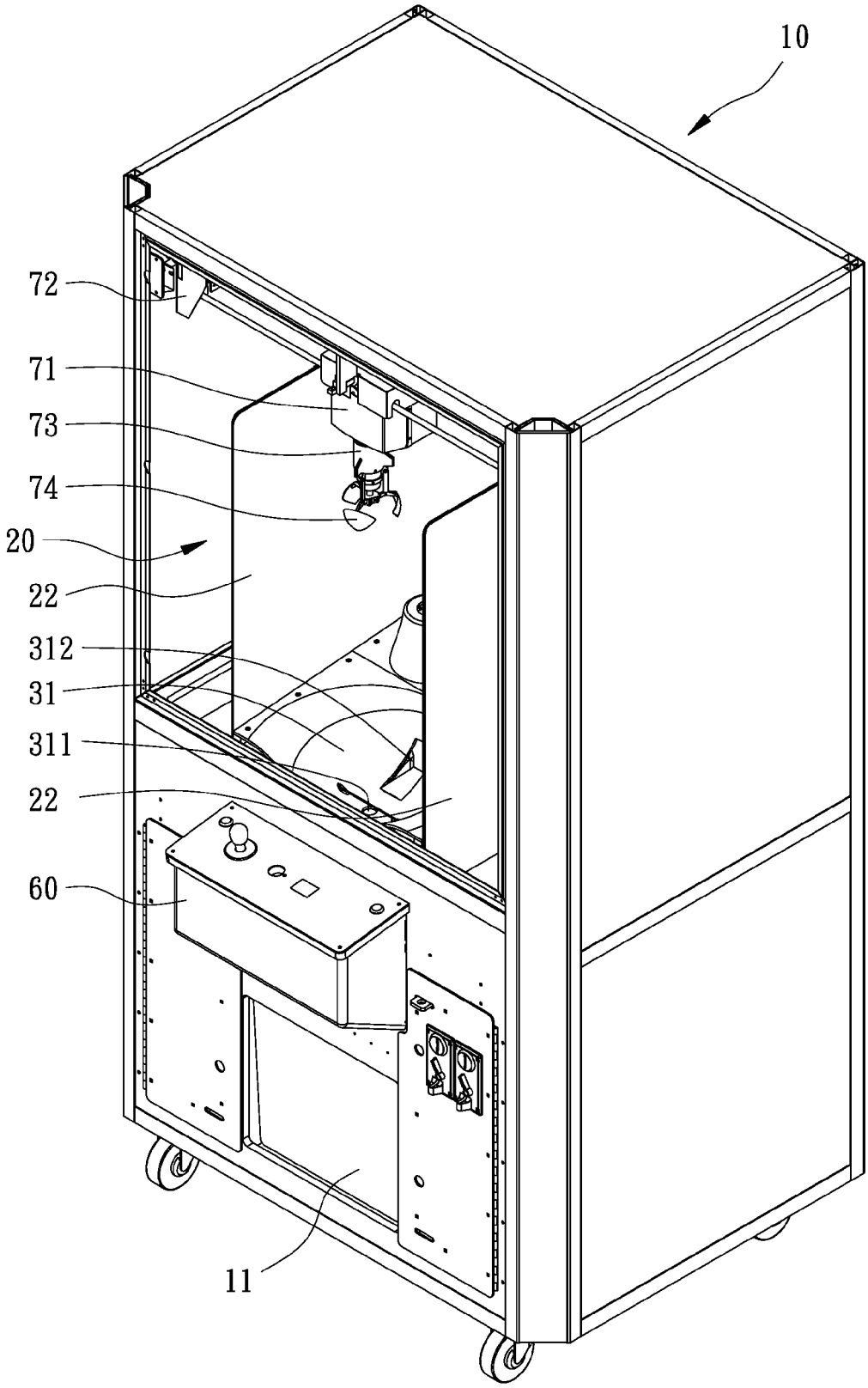
FIG. 1 is a perspective view of a game machine in accordance with the present invention.
Figure 2:
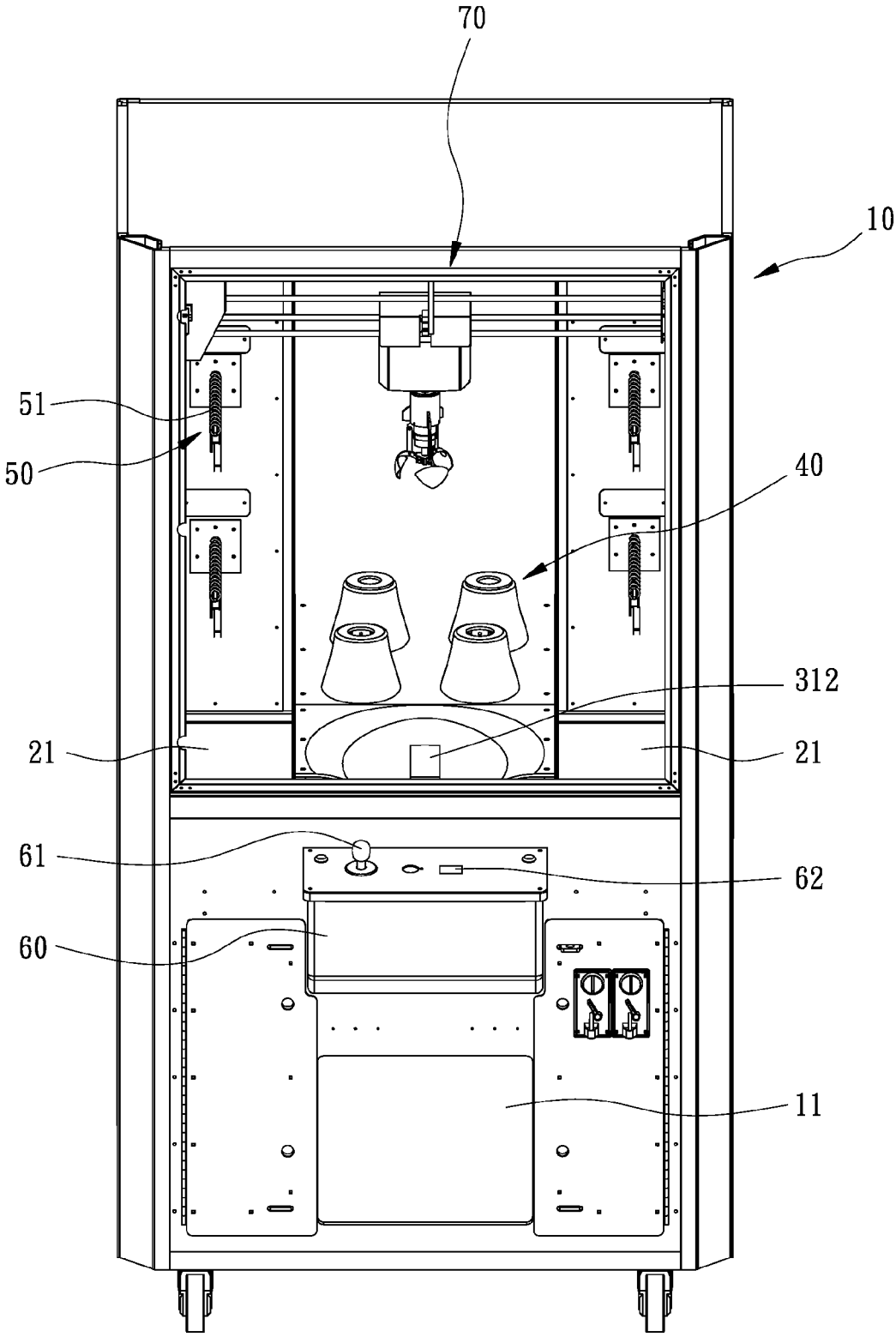
FIG. 2 is a front plan view of the game machine in FIG. 1.
Figure 3:
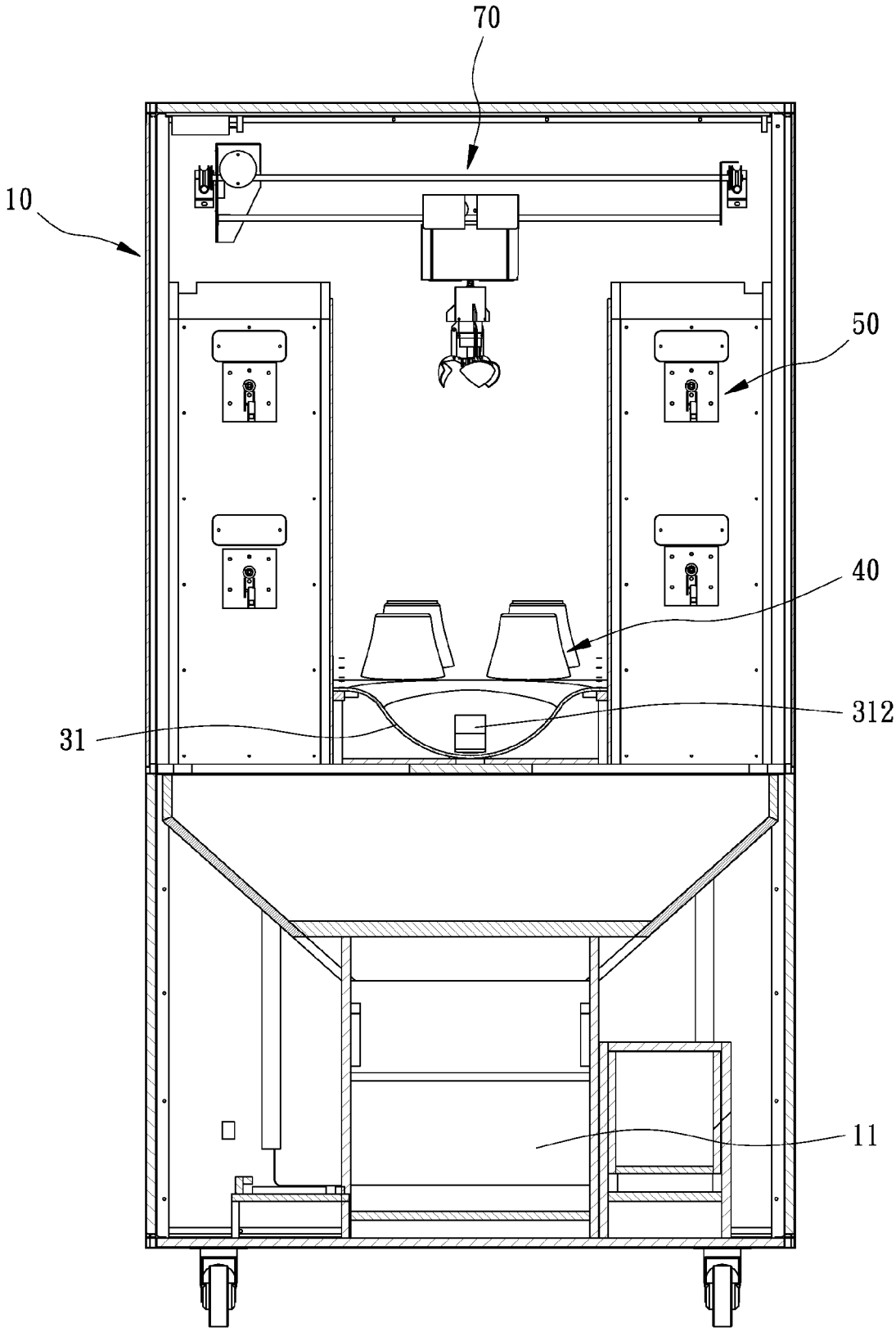
FIG. 3 is a front cross-sectional view of the game machine in FIG. 1.
Figure 4:
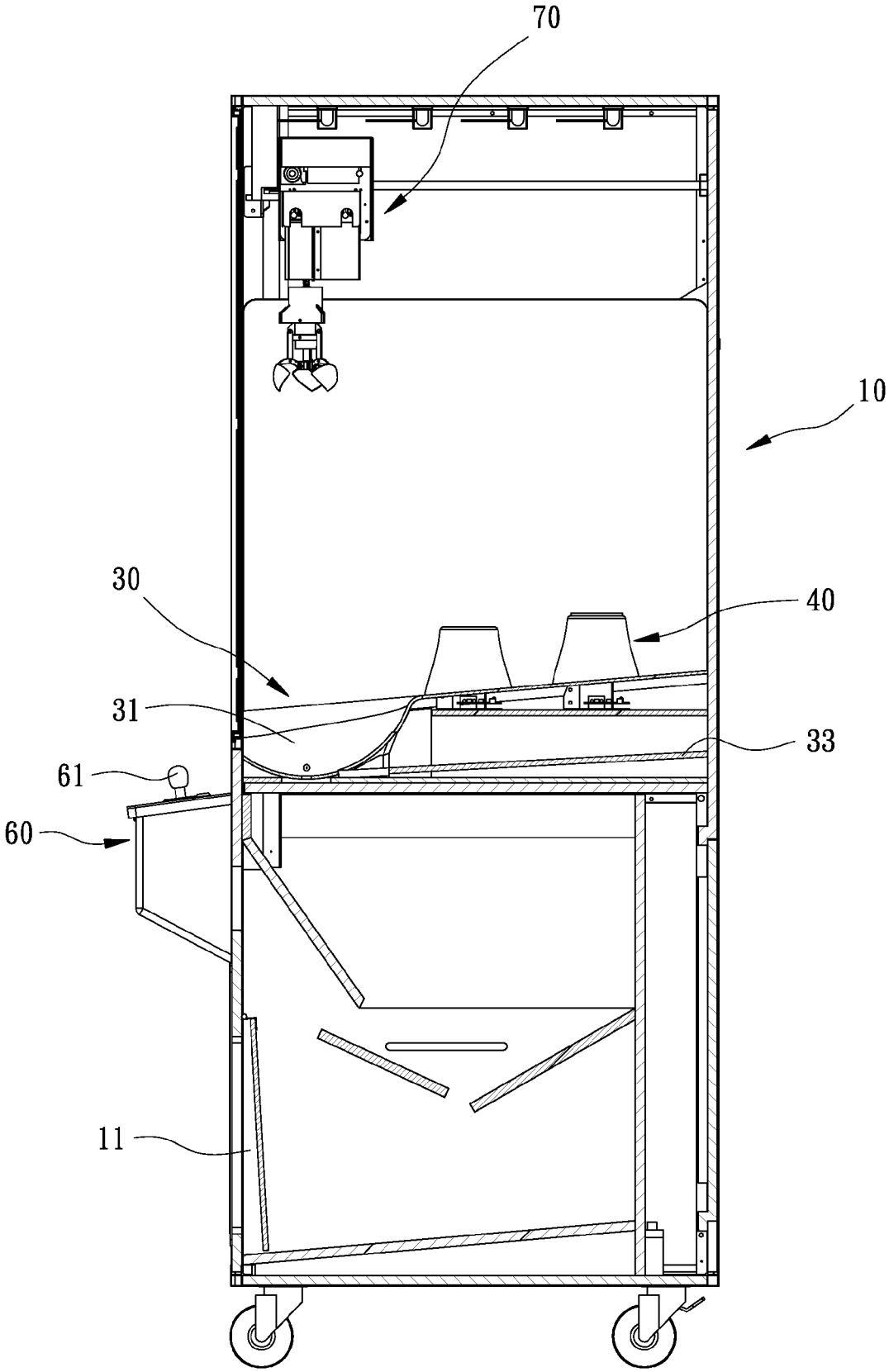
FIG. 4 is a side cross-sectional view of the game machine in FIG. 1.
Figure 5:
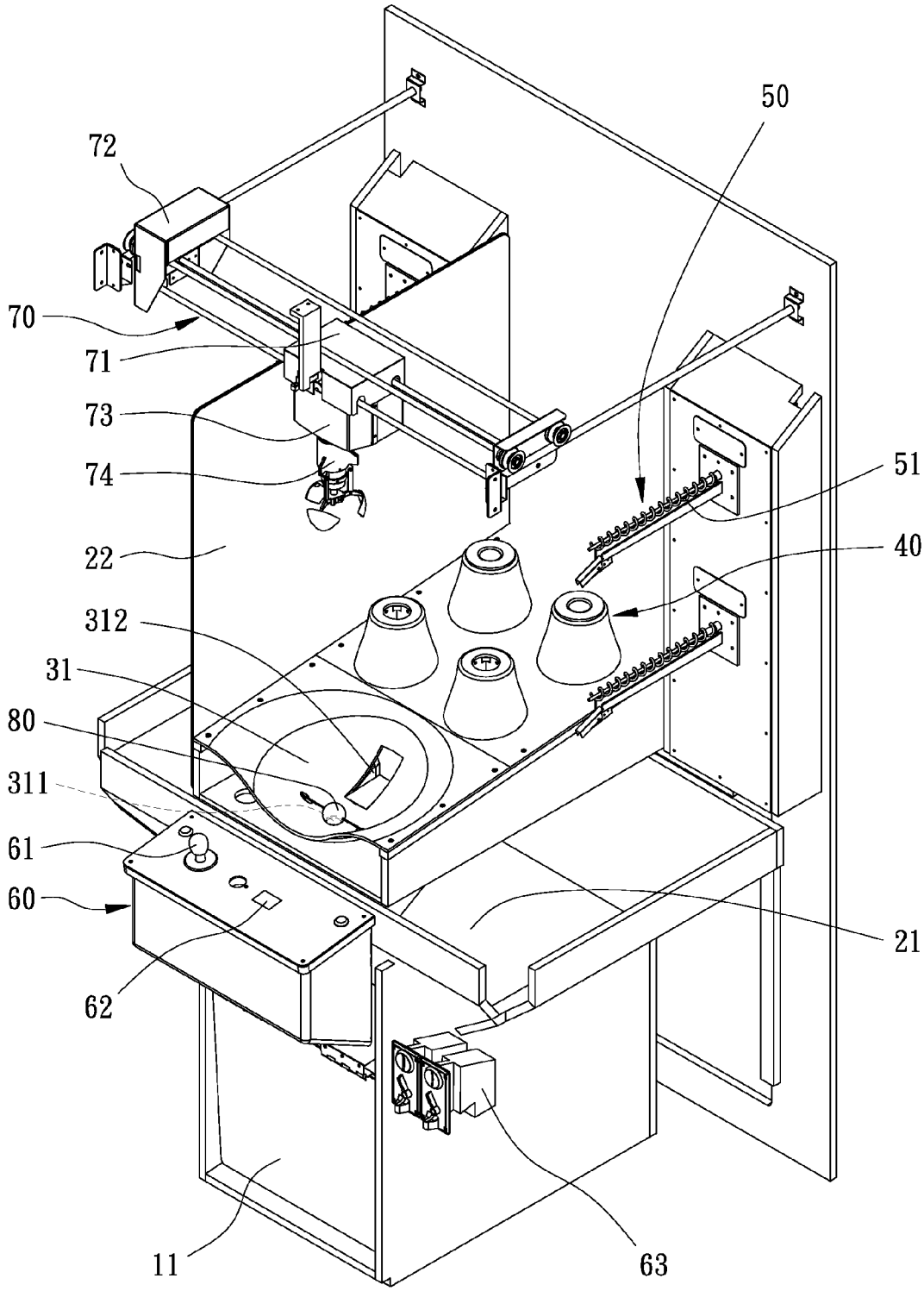
FIG. 5 is a partially perspective view of the game machine in accordance with the present invention.
Figure 6:
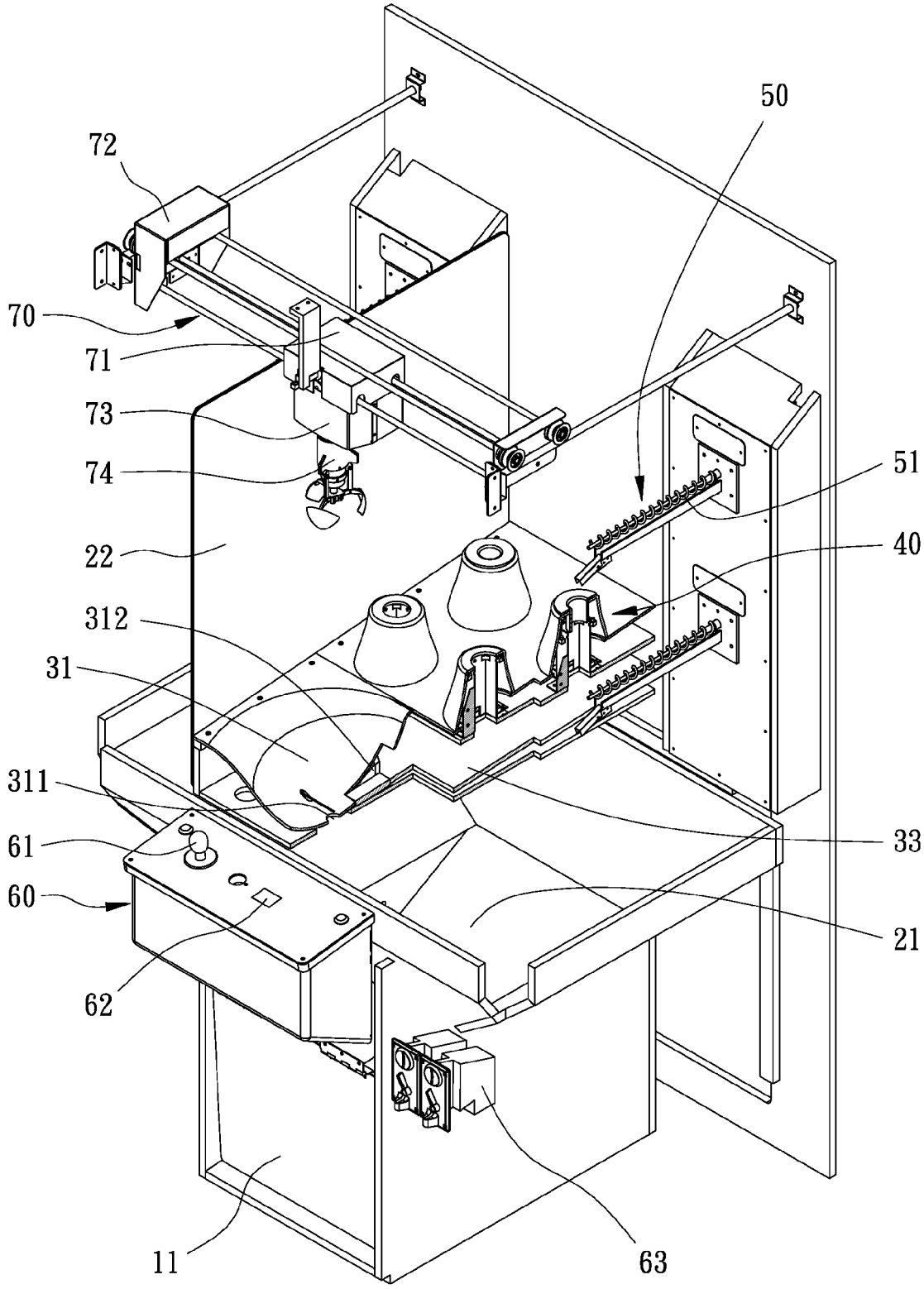
FIG. 6 is a partially cross-sectional view of the game machine in FIG. 5.
Figure 7:
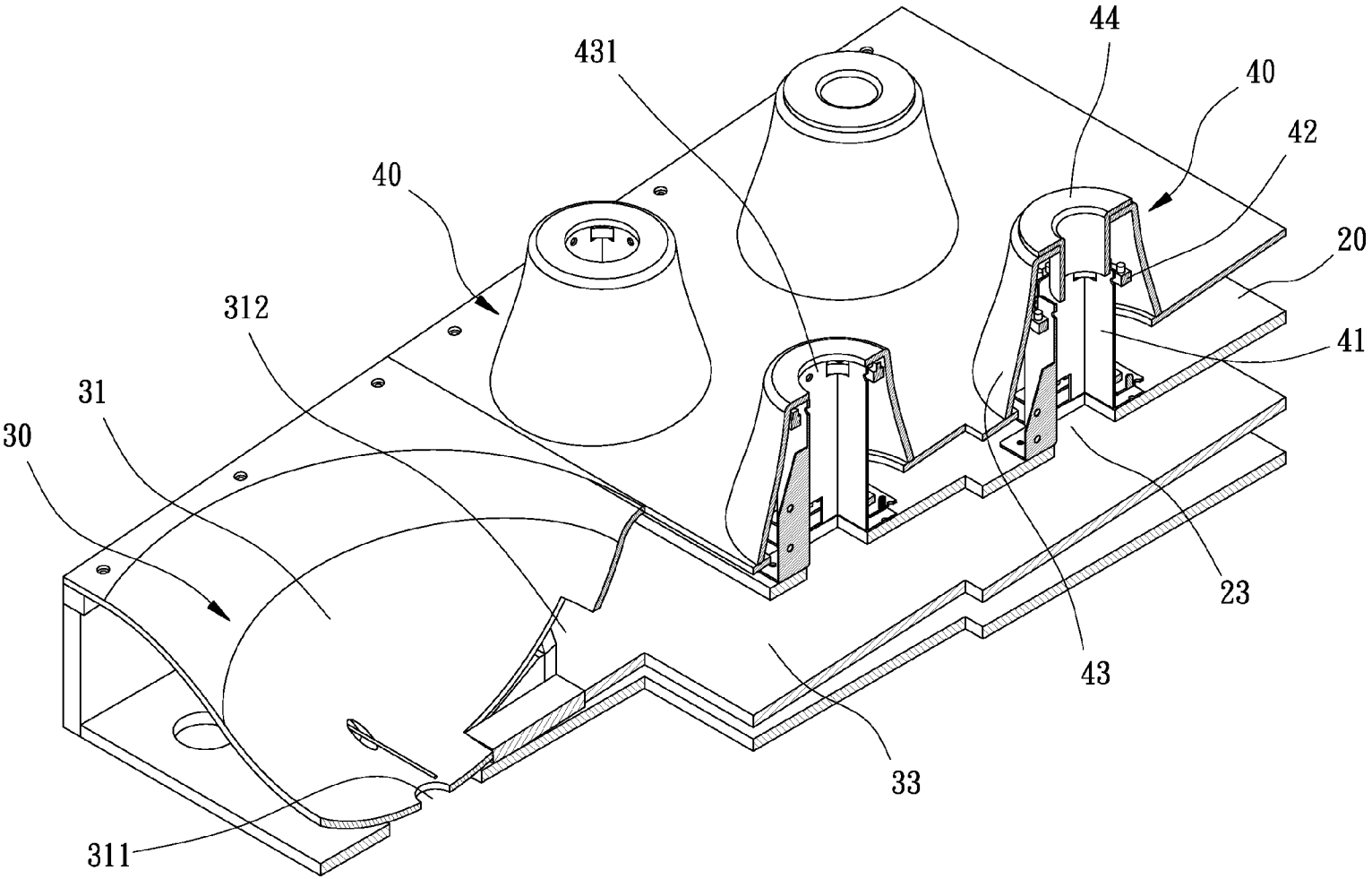
FIG. 7 is a partially enlarged cross-sectional view of the game machine in FIG. 5.

Referring to the drawings and initially to FIGS. 1-7, a game machine in accordance with the present invention comprises a main frame (10) standing on a supporting surface, a partition (20) front slantingly mounted on a middle portion of the main frame (10). A collecting device (30) is mounted onto an underside of the partition (20) and multiple falling ball sense units (40) are mounted onto an upside of the partition (20). Multiple prize dispensing devices (50) are mounted onto an internal panel of the main frame (10) and electrically connected to a corresponding one of the falling ball sensing units (40). A control unit (60) is secured on a front panel of the main frame (10) and an operational unit (70) is disposed to an upper portion of the main frame (10), wherein the operational unit (70) is electrically connected to the control unit (60). When starting a game, the operational unit (70) firstly catches a ball (80) from the collecting device (30) and make the caught ball (80) targeting a selected falling ball sense unit (40), and then releasing the ball (80). A corresponding prize dispensing device (50) is operated to dispense a prize when the targeted falling ball sense unit (40) senses the falling ball (80). On the other hand, the prize dispensing device (50) is idle and the operator gets no prize.

The main frame (10) includes a prize dispensing hole (11) defined in the front panel thereof under the control unit (60) for operator to easily take the prize.

The partition (20) has at least one opening (21) defined in one side thereof and communicating with the prize dispensing hole (11). In the preferred embodiment of the present invention, the partition (20) includes two openings (21) respectively defined in two opposite side thereof. The partition (20) includes at least one side plate (22) upwardly extending therefrom to prevent the ball (80) from falling into the prize dispensing hole (11) through the opening (21). The partition (20) includes multiple through holes (23) defined therein and each through hole (23) aligns with a corresponding one of the falling ball sense units (40).

The collecting device (30) includes a bowl (31) defined in a front portion of the partition (20) and an indentation (311) defined in a bottom of the bowl (31). The ball (80) is positioned and partially received in the indentation (311) when the game is finished. A sensor (32) is disposed in the collecting device (30) near the indentation (311). The sensor (32) transfers a signal to the operational unit (70) to make the operational unit (70) moving to its original place when the sensor (32) senses the ball (80) in the indentation (311). The bowl (31) has a passage (312) defined in a rear portion thereof. The collecting device (30) includes a guide plate (33) mounted under the partition (20). The guide plate (33) guides the ball (80) rolling into the bowl (31) through the passage (312) after ball (80) passing through the falling ball sense unit and the corresponding through holes (23) in the partition (20).

Each falling ball sense unit (40) includes a hollow stub (41) mounted on the partition (20) and surrounding the corresponding through hole (23) in the partition (20). Each hollow stub (41) has a falling ball sensor (41) mounted on a top portion thereof. A tapered structure (43) is sleeved on the hollow stub (41) and a hole (431) is defined in the top of the tapered structure (43), wherein the hole (431) co-axially aligns with the corresponding through hole (23) in the partition (20). Consequently, the ball (80) can smoothly pass through the targeted falling ball sense unit (40) and into the collecting device (30). For promoting the degree of difficulty of the present invention and providing a prize having a high value, a sleeve (44) is received in the hole (431) of the corresponding tapered structure (43) for reducing the diameter of the hole (431).

Each prize dispensing device (50) includes a spiral element (51) having a free end corresponding to the opening (21) in the partition (20). The spiral element (51) is rotated to make the prize (not shown), hung on the spiral element (51), falling into the prize dispensing hole (11) through the opening (21) when the falling ball sensor (42) senses the fall ball (80) and transfers a signal to the prize dispensing device (50).

The operational unit (70) includes an X-axis moving device (71), a Y-axis moving device (72) and a Z-axis moving device (73), wherein the Z-axis moving device (73) is mounted onto an underside of the X-axis moving device (71). A catcher (74) is mounted on the Z-axis moving device (73) for catching/releasing the ball (80). The operator can uses the X-axis moving device (71) and the Y-axis moving device (72) to make the catcher (74) aligning with the selected falling ball sense unit (40).

The control unit (60) includes a stick (61) and a button (62) disposed thereon, wherein the stick (61) is used to operate the X-axis moving device (71) and the Y-axis moving device (72), and the catcher (74) releases the ball (80) when the catcher (74) is aligned with the selected falling ball sense unit (40) and the button (62) is pressed. A slot (63) is defined in the control unit (60) for user to insert coin(s) or token(s) for starting the game.

After inserting coin(s)/token(s), the Z-axis moving device (73) automatically and downward drives the catcher (74) to catch the ball (80) located in the indentation (311) and the catcher (74) is moved to its original position by the Z-axis moving device (73) after catching the ball (80). At this time, the operator can operates the X-axis moving device (71) and the Y-axis moving device (72) via the stick (61) to make the catcher (74) aligning with the selected falling ball sense unit (40), and operates the catcher (74) to release the ball (80) via the button (62). The ball (80) directly rolls into the bowl (31) along the partition (20) after falling when the catcher (74) does not accurately target the selected falling ball sense unit (40). The falling ball (80) sequentially passes through the hole (431) in the tapered structure (43), the hollow stub (41) and the through hole (23) in the partition (20), and rolls into the bowl (31) along the guide plate (33) through the passage (312) when the catcher (74) with the ball (80) is accurately targeted the selected falling ball sense unit (40). The corresponding spiral element (51) is rotated to make the hung prize falling into the prize dispensing hole (11) through the opening (21) when the falling ball sensor (42) senses the falling ball (80) passing through the hollow stub (41).

The ball (80) is finally positioned in the indentation (311) due to the shape of the bowl (31). The operational unit (70) is moved to its original position and the catcher (74) is aligned with the ball (80) in the indentation (311) when the sensor (32) senses the ball (80) in the indentation (311).

The win probability of the game machine in accordance with the present invention is completely directed to the operations of the user and is not directed to the hardware of the game machine. Consequently, the fairness of the game machine of the present invention is promoted and the game machine is attractive because it has a new and novel play method.

Although the invention has been explained in relation to its preferred embodiment, it is to be understood that many other possible modifications and variations can be made without departing from the spirit and scope of the invention as hereinafter claimed.

What is claimed is:

1. A game machine comprising:

a main frame having a prize dispensing hole defined in a lower portion of a front panel thereof;

a partition front slantingly mounted on a middle portion of the main frame, the partition including at least one opening defined in one side thereof and communicating with the prize dispensing hole, and at least one side plate upwardly extending therefrom for separating the at least one opening;

multiple prize dispensing devices respectively mounted onto an internal panel of the main frame;

an operational unit disposed to an upper portion of the main frame, the operational unit including an X-axis moving device, a Y-axis moving device and a Z-axis moving device, wherein the Z-axis moving device is mounted onto an underside of the X-axis moving device, a catcher mounted on the Z-axis moving device for catching/releasing a ball;

multiple falling ball sense units mounted onto an upside of the partition, wherein the prize dispensing device is driven to dispensing a prize when a corresponding one of the falling ball sense units senses the falling ball;

a control unit secured on the front panel of the main frame for controlling and operating the X-axis moving device and the Y-axis moving device to make the catcher targeting a selected one of the falling ball sense units; and a collecting device mounted onto an underside of the partition, the collecting device including a bowl defined in a front portion of the partition and an indentation defined in a bottom of the bowl, wherein the ball is positioned and partially received in the indentation when the game is finished, a sensor disposed in the collecting device near the indentation, wherein the sensor transfers a signal to the operational unit to make the X-axis moving device with the Z-axis moving device moving to its original position when the sensor senses the ball in the indentation.

2. The game machine as claimed in claim 1, wherein the partition includes multiple through holes defined therein and each through hole aligns with a corresponding one of the falling ball sense units.

3. The game machine as claimed in claim 2, wherein Each falling ball sense unit includes a hollow stub mounted on the partition and surrounding a corresponding one of the through holes in the partition, each hollow stub having a falling ball sensor mounted on a top portion thereof, a tapered structure sleeved on the hollow stub and a hole defined in the top of the tapered structure, wherein the hole co-axially aligns with the corresponding through hole in the partition and the ball can smoothly pass through the targeted falling ball sense unit and into the collecting device.

4. The game machine as claimed in claim 3, wherein the bowl has a passage defined in a rear portion thereof and the collecting device includes a guide plate mounted under the partition, the guide plate guiding the ball rolling into the bowl through the passage after ball passing through the falling ball sense unit and the corresponding through holes in the partition.

5. The game machine as claimed in claim 4, wherein each falling ball sense unit further includes a sleeve received in the hole in the tapered structure for reducing a diameter of the hole and promoting the degree of difficulty of the game machine to provide a prize that has a high value.

6. The game machine as claimed in claim 3, wherein each falling ball sense unit further includes a sleeve received in the hole in the tapered structure for reducing a diameter of the hole and promoting the degree of difficulty of the game machine to provide a prize that has a high value.

* * * * *